United States Patent [19]

Zietlow, Jr.

[11] 4,004,625

[45] Jan. 25, 1977

[54] CONTAINER FOR ANCHOR AND LINE

[76] Inventor: John F. Zietlow, Jr., 37 Berkley Place, Buffalo, N.Y. 14209

[22] Filed: Nov. 3, 1975

[21] Appl. No.: 627,971

[52] U.S. Cl. ..... 150/7; 114/294; 150/52 R; 150/1

[51] Int. Cl.[2] ..... B65D 33/24

[58] Field of Search ..... 150/1, 3, 7, 11, 52 R; 114/206 R, 210

[56] References Cited

UNITED STATES PATENTS

| | | | |
|---|---|---|---|
| 1,894,868 | 1/1933 | Hokerk | 150/1 UX |
| 2,338,279 | 1/1944 | Blake | 150/7 |
| 2,430,763 | 11/1947 | Foster | 150/7 X |
| 2,431,030 | 11/1947 | Edwards | 150/11 X |
| 2,437,149 | 3/1948 | Baxter | 150/11 X |
| 3,521,689 | 7/1970 | Woods | 150/3 X |
| 3,676,882 | 7/1972 | Lindquist | 9/14 |

*Primary Examiner*—Donald F. Norton

*Attorney, Agent, or Firm*—Christel & Bean

[57] ABSTRACT

A bag-like container of flexible material such as canvas for stowing an anchor and a length of line. The container has a hollow body closed at one end and open at the other and a plurality of pockets are spaced along and around the inner surface of the container body. The pockets are open adjacent the open end of the container body, and the aggregate size of the pockets is sufficient to contain the line. The anchor is stowed in the hollow container body, the line is cumulatively stowed in the pockets, and a closure flap is fastened over the open container end and pockets all in a manner preventing fouling of the anchor and line. When the anchor is removed from the container for use, the lie can be payed out sequentially in a manner avoiding tangling.

11 Claims, 7 Drawing Figures

CONTAINER FOR ANCHOR AND LINE

BACKGROUND OF THE INVENTION

This invention relates to the art of marine equipment, and more particularly to novel apparatus for stowing and handling an anchor and line.

The stowage and handling of anchor and line on boats has been a continuing problem. On small boats, particularly, the anchor and line are stowed at a location on the boat different or relatively remote from the location where the anchor is put in use thereby requiring transportation of the anchor-line combination between these locations. The nature and construction of an anchor whereby it is intended to foul on the bottom of the body of water supporting the boat also can cause it to foul on other objects as well during stowage and transportation. In addition, the coiled line together with chain and anchor often are carried separately to the place of stowage, and during stowage the line and chain can foul on the anchor. Furthermore, this practice requires manual handling of the line in a manner such that it does not foul when payed out. The problems normally encountered during stowage and handling of anchor and line are compounded with novices and others lacking adequate boating experience, and even more so during emergency situations.

SUMMARY OF THE INVENTION

It is, therefore, an object of this invention to provide a new and improved container for stowing an anchor and line.

It is a further object of this invention to provide such a container which prevents fouling of the anchor and line during stowage.

It is a further object of this invention to provide such a container which allows the line to be payed out in a non-fouling manner when the anchor is put in use.

It is a further object of this invention to provide such a container which affords convenient and easy transportation of the anchor and line to a location of stowage separate from the location where the anchor is put into use.

It is a further object of this invention to provide such a container for stowing the anchor and line in a single, non-fouling package with relatively simple and quick handling and with safety and efficiency.

It is a further object of this invention to provide such a container which is relatively easy and economical to manufacture.

The present invention provides a container for stowing an anchor and a length of line connected thereto, the container comprising a hollow body portion having an interior region open at one end of the container and of sufficient size to contain the anchor and a plurality of pockets spaced along the hollow body portion, each pocket being open adjacent the open end of the container and the pockets together being of sufficient size to accommodate the line. The pockets are positioned in the container and the line is cumulatively fitted in the pockets in a manner such that the anchor and line are stowed in the container in a non-fouling manner and when the anchor is removed for use, the line is payed out from the pockets sequentially in a non-fouling manner. The container body portion and pockets preferably are of flexible fabric material, such as canvas material, and a closure element or flap is provided for covering the openings of the container body and pockets during storage.

The foregoing and additional advantages and characterizing features of the present invention will become clearly apparent upon a reading of the ensuing detailed description, together with the included drawing wherein:

BRIEF DESCRIPTION OF THE DRAWING FIGURES

DETAILED DESCRIPTION OF THE ILLUSTRATED EMBODIMENT

Figure 1:
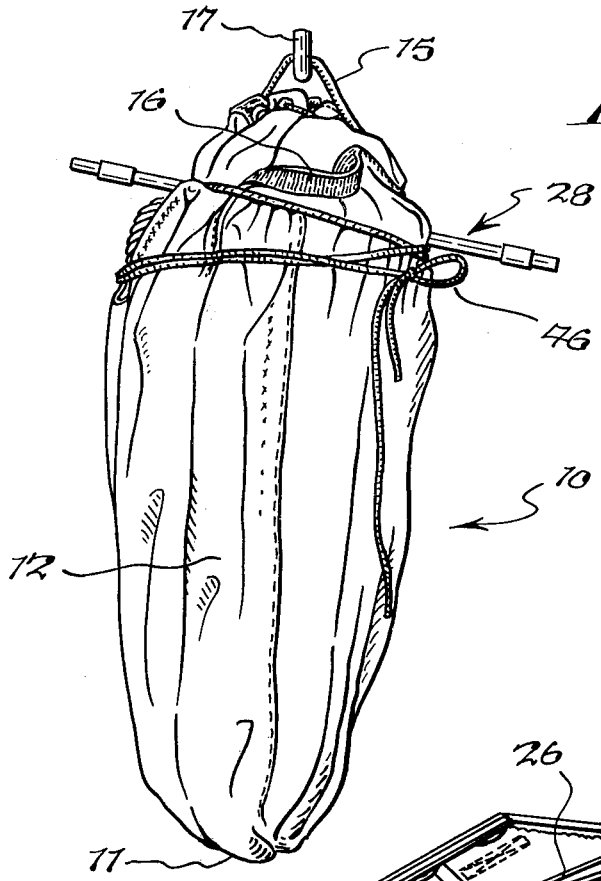
FIG. 1 is an elevational view of an anchor container according to the present invention as it would appear when stowing an anchor and line on a boat.
Figure 3:
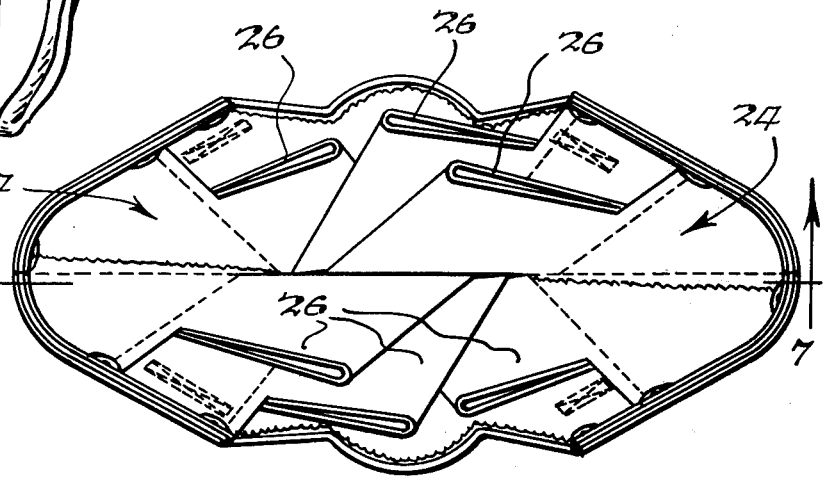
FIG. 3 is a view looking down into an open anchor container or bag according to the present invention with parts removed and showing the main compartment and auxiliary compartments thereof.
Figure 2:
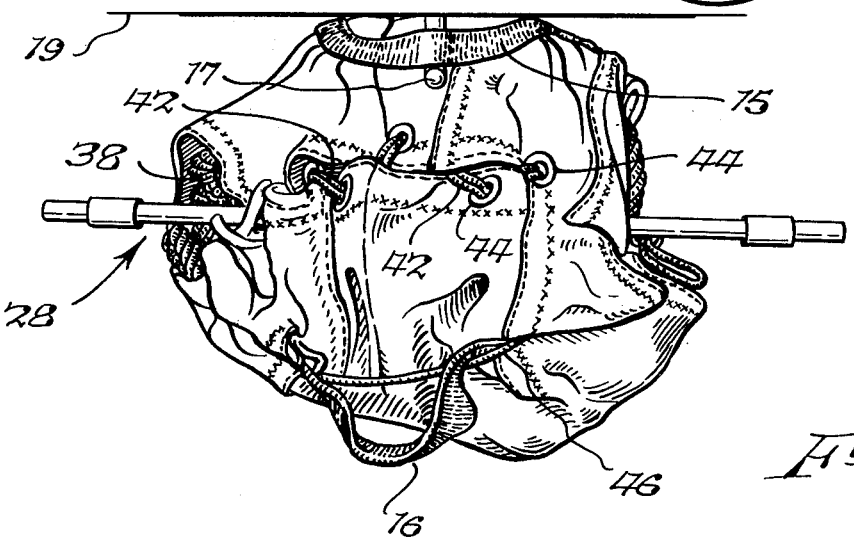
FIG. 2 is a top plan view of the container of FIG. 1.

Referring now to FIGS. 1 and 2, an anchor container or case according to the present invention, generally designated 10, stores or houses an anchor and its line therein, and the entire assembly or package can be stored on a boat at any desired location, often away from the point where the anchor line is to be fastened to the boat. Container 10 comprises a hollow body portion which is closed at one end 11 designated the bottom as viewed in FIG. 1, and has a top as viewed in FIG. 1 including flaps which can be opened and closed in a manner which will be described. A pair of handles or grips in the form of strap elements 15, 16 are fixed to the upper end of container 10. Container 10 is shown in FIGS. 1 and 2 in a typical position of storage wherein handle 15 engages a hook-like element 17 fixed to the wall 19 of the boat or vessel from which the container 10 is hung or otherwise supported in an upright or vertically disposed position.

Figure 4:
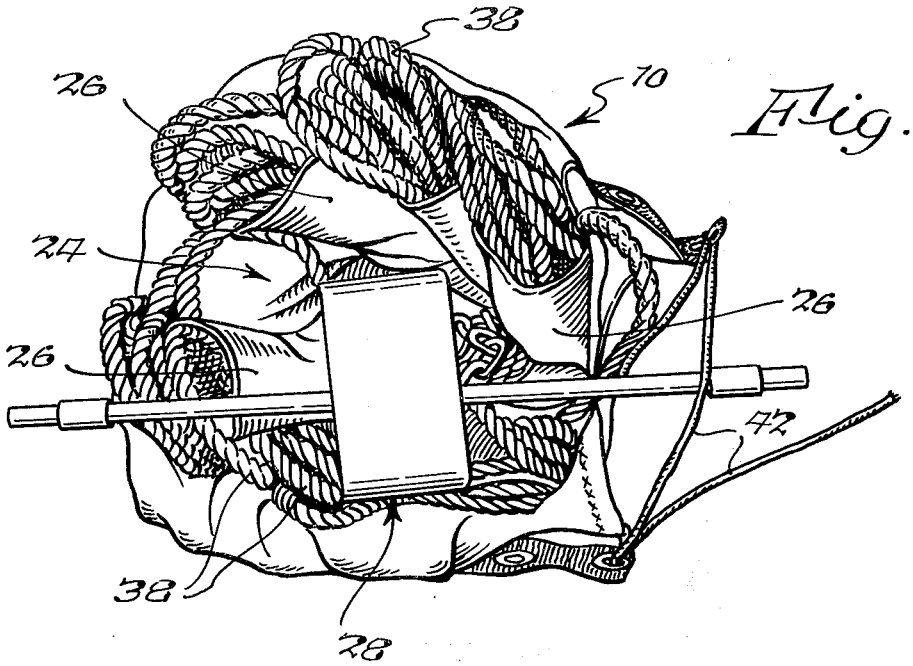
FIG. 4 is a plan view similar to FIG. 2 wherein the top of the container is open to reveal its contents.

The interior of container 10 includes a main compartment or chamber 24 and a plurality of auxiliary compartments or pockets 26 positioned around and along the container body, in particular around and along the inner surface of container 10. Each pocket 26 has a hollow body portion closed at one end and open at the other end thereof adjacent the open end of container 10. Each pocket 26 extends along the inner surface or interior of the container body portion in a generally lengthwise direction from the closed end or bottom area of the container to a point spaced slightly inwardly of the opposite end or top portion of the container. Each pocket is generally cylindrical in shape, in some instances slightly conical, and is closed adjacent the bottom closed portion of container 10 and is open at the top end of container 10. The anchor is stored in the main compartment 24 as shown in FIG. 4, and the line is stored in the auxiliary compartments 26 in successive portions or increments. When the anchor is removed from container 10, the line can be payed out in an orderly manner thereby avoiding tangling and fouling thereof in a manner which will be described in detail presently.

Figure 5:
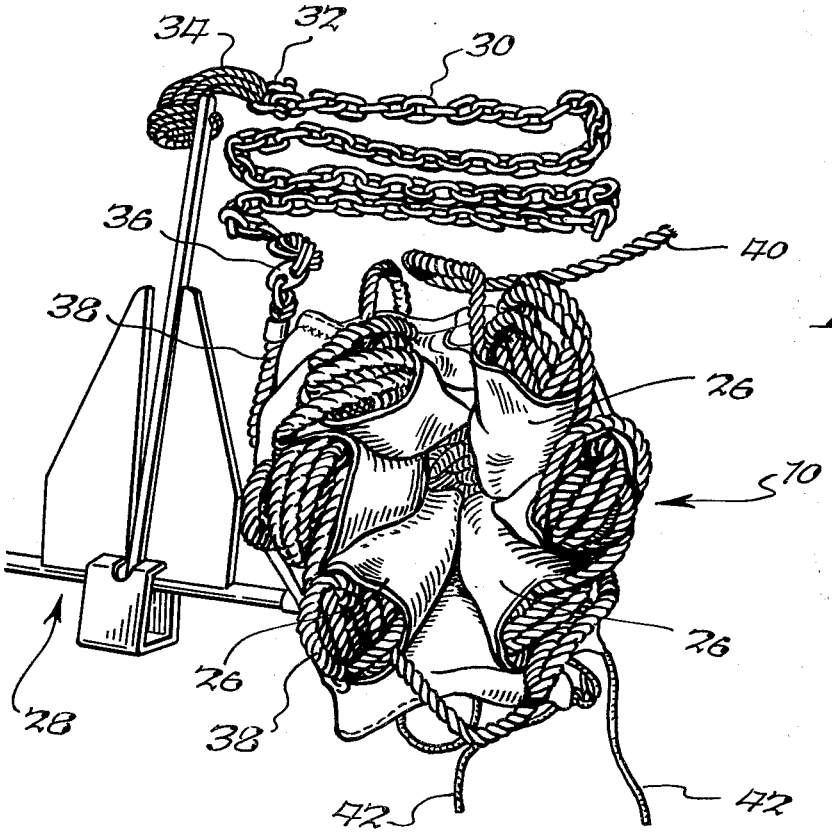
FIG. 5 is a plan view similar to FIG. 4 with the anchor and some of the line removed therefrom.

Container 10 preferably is in the form of a bag of flexible material, preferably cloth material or fabric such as canvas, with the main body portion including bottom, side and top together with the interior pockets preferably all being of the same material. The anchor and line combination is shown in FIG. 5 partially withdrawn from container 10, and the illustrative anchor 28 shown in the drawings is a well-known Danforth anchor. The line includes a chain 30 connected at one end to a shackle 32 which, in turn, is connected through a short length of rope 34 to anchor 28. Chain 30 is typically about six feet in length and is connected at the other end through a Brommel type hook 36 to one end of a fairly long length of rope 38. Rope 38 is stowed in the compartments or pockets 26, and the other end 40 of rope 38, known as the bitter end, is available for fastening to the boat when the anchor is cast overboard in a known manner. Rope 38 is coiled into hanks which then are inserted into the pockets 26 in a sequential or successive manner, each pocket typically holding 28 feet of rope. The rope typically is coiled by hand around the person's forearm, and when the coil is formed it is compressed or flattened to facilitate fitting into the respective pocket. FIGS. 4 and 5 illustrate the rope 38 stowed sequentially in the pockets 26 with bights of rope between the pockets. Then chain 30 is dropped or placed in the main compartment 24 and then anchor 28 inserted therein whereupon container 10 is closed at the top by lacing or otherwise connecting a closure cord 42 through eyelets 44 provided at spaced locations along opposite edges of the top closure elements or flaps. When secured in a closed position, the flaps leave two small openings on opposite sides of the container to accommodate the laterally extending anchor rod or stock. In addition, an auxiliary cord or line 46 is wrapped and tied around the upper portion of the container which augments the closure and serves to prevent chain 30 from working out from the container when subjected to vibrations. Alternatively, one single cord could be used in place of the separate cords 42 and 46.

The package or assembly comprising container 10 with the anchor and line closed therein is conveniently and easily transported. Container 10 has a rugged construction and has a smooth, nonfouling exterior surface. Thus there is provided a non-fouling covering for the anchor together with structure for stowing the line components in a nonfouling manner. This is of particular significance because an anchor by its nature is susceptible to fouling. By virtue of the container construction, handles 15, 16 are located relatively close to the center of gravity of anchor 28 thereby reducing pendular actions of the torsional and gravity type which makes transportation of the package easier. In other words, the handles are so located that with the anchor in the case 10, the entire package will not be self dumping. Furthermore, such pendular action is reduced when the package is supported from either handle 15 or 16 in an upright manner as shown in FIG. 1. The foregoing promotes safety by reducing the possibility of accidental dumping of the anchor and line with its attendant disorder and hazard.

When use of anchor 28 is required, the package illustrated in FIG. 1 is brought to the point on the boat where the anchor is to be passed overboard, cord 46 is removed, and the top of container 10 is opened by removing the rope or cord 42 to permit the top flaps to be opened. The bitter end 40 of rope 38 is fastened to a fitting on the boat structure, and then anchor 28 is removed from container 10. A portion of rope 38 is withdrawn by hand from container 10 and as anchor 28 is dropped overboard the remaining portion of rope 38 is payed out sequentially or successively and orderly in a nonfouling manner due to the arrangement of the series of pockets 26. The anchor and line thus are put in use with relatively simple and quick handling and with safety and efficiency. The anchor container or case of the present invention thus enables the rope, chain and anchor to be connected together at the time the bag is packed or stowed so that all that is required is that the package be opened when needed and the anchor and line whooshed or lowered overboard, the bitter end of the rope generally being properly fastened to the boat beforehand. With the anchor overboard in position of use and with all of rope 38 removed from container 10, it can be simply folded and stored in a convenient location. Then when the anchor is pulled up, rope 38 is coiled in a manner as previously described and inserted into pockets 26, anchor 28 and chain 30 are placed in compartment 24, the container is again closed by means of the ties 42 and 46, and then the package is carried easily and conveniently to a place of storage.

Due to the flexible material, the container 10 can be turned inside out so that the pockets 26 are then on the outside. This facilitates filling the pockets with rope or line whereupon the container can be manipulated again to return the filled pockets to the interior thereof.

In addition to storing a single integral length of line, container 10 can of course store a plurality of discreet, separate lengths of line. For example, assuming that a container has pocket capacity to hold about 300 feet of line, a single 150 foot length of line could be stored thereby leaving 150 feet of storage capacity for one or more additional lines.

Figure 7:
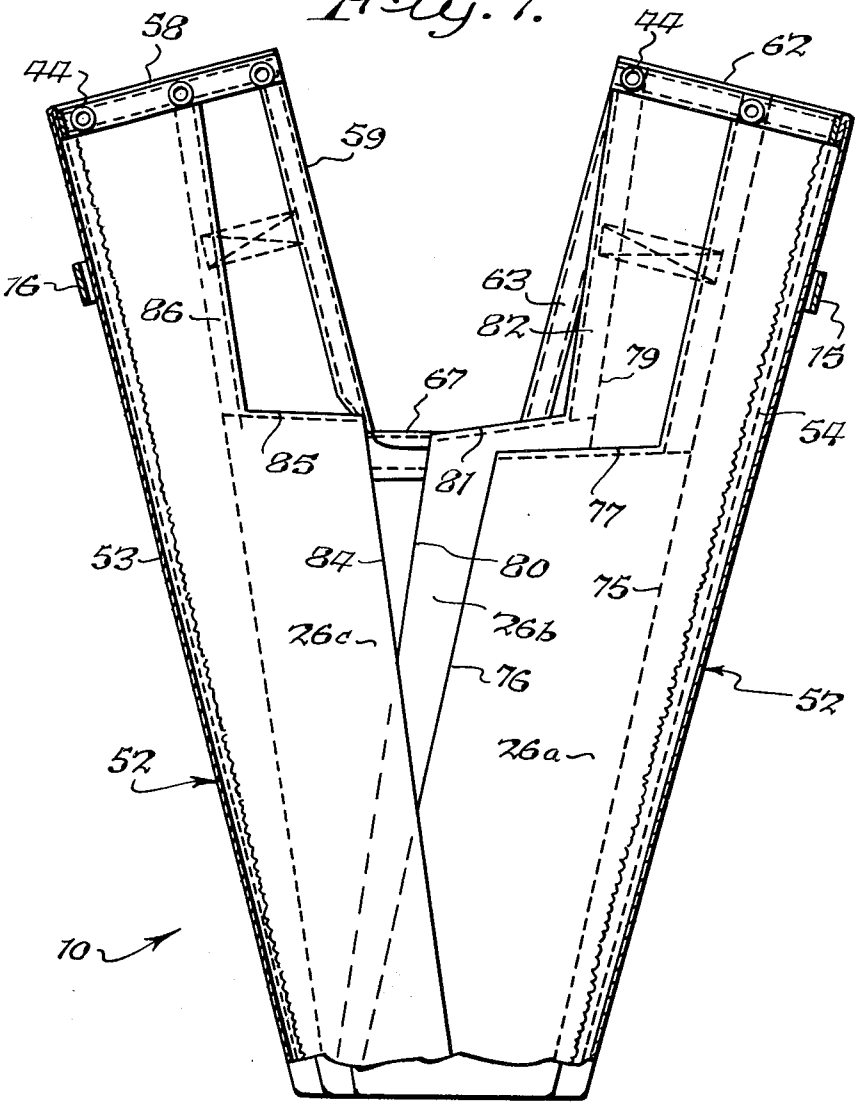
FIG. 7 is a sectional view taken on a plane cutting through the joining edges of the front and rear faces of the container FIG. 6 and also about on line 7—7 in FIG. 3.
Figure 6:
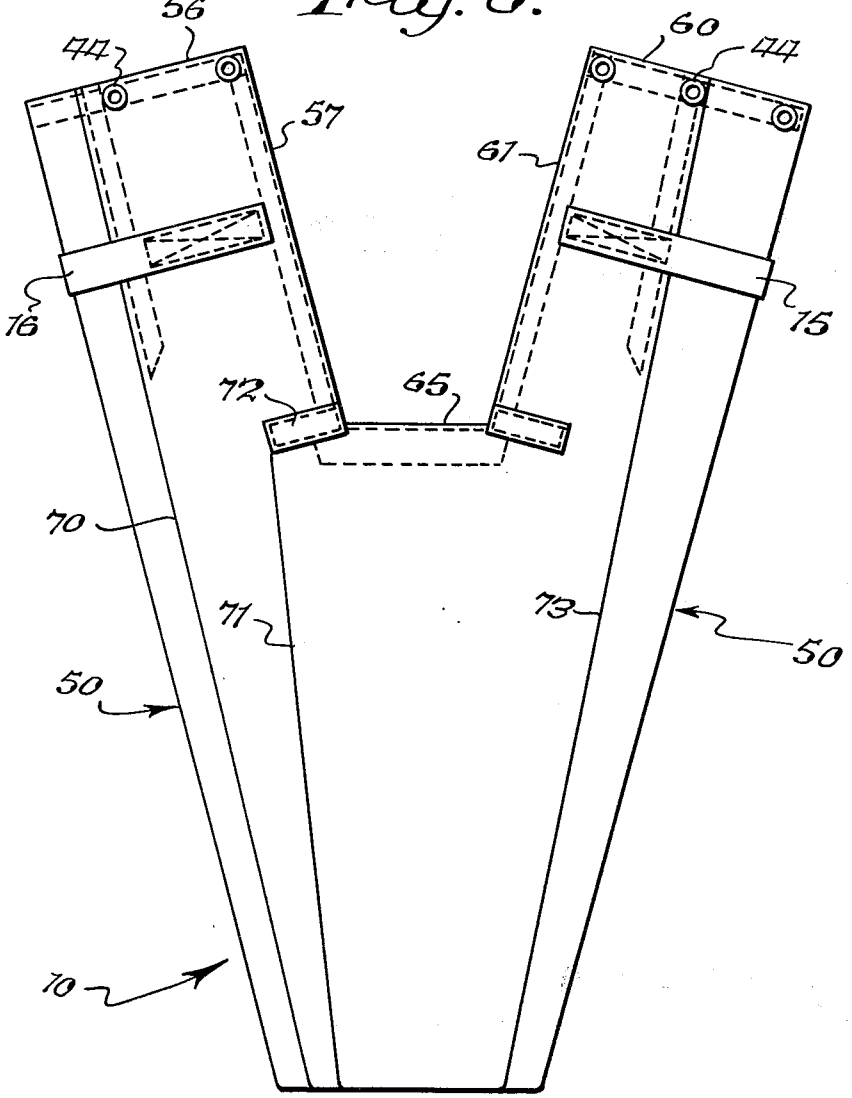
FIG. 6 is a front side exterior of an anchor container according to the present invention in a flattened out condition, the rear side being identical.

Container 10 preferably is in the form of a bag of flexible material, for example canvas material, and a preferred construction and manner of making the same are illustrated in FIGS. 6 and 7 which are views of an empty container bag 10 flattened out on a flat surface. The bag 10 can be viewed as comprising two main components 50 and 52 as seen in FIGS. 6 and 7, respectively of the same outline and which are sewn together along the two opposite sides and along one end which is the bottom as viewed in FIGS. 6 and 7. The parts 50, 52 are sewn together along a seam 53 at the left-hand side as shown in FIG. 7, are sewn together along a seam 54 at the right-hand side as shown in FIG. 7, and are sewn together at the bottom end as viewed in FIGS. 6 and 7. Each part 50, 52 is formed from a plurality of sub-components or smaller parts in a manner which will be described. Each main part, for example, part 50 as shown in FIG. 6, has a somewhat trapezoidal-shaped main body portion wherein the shorter base of the trapezoid is coincident with the smaller or bottom end of part 50, the trapezoidal portion comprising a major portion of the pattern or part. Extending from the longer base of the trapezoidal portion are two spaced apart leg portions which are integral with the trapezoidal portion and which provide the closure flaps of the completed bag assembly. A throat or open region defined therebetween serves to accommodate the laterally extending rod portion of the anchor in the completed bag assembly comprising the two parts 50, 52 sewn together.

The outer end edge 56 and the inner edge 57 of the left-hand leg portion of part 50 shown in FIG. 6 and, similarly, the upper end edge 58 and the inner edge 59 of the left-hand leg of part 52 shown in FIG. 7 are defined by folding a portion of the cloth inwardly and stitching to provide a reinforcement strip along the region of these edges. Similarly, outer end edge 60 and inner edge 61 of the right-hand leg portion of part 50 and the outer end edge 62 and inner edge 63 of the right-hand leg portion of part 52 are defined by folding a portion of the cloth inwardly and stitching to provide reinforcing strips along such edges. The plurality of eyelets 44 are provided in and along the reinforcing strips defined along the upper end edges 56, 58, 60 and 62 to receive the tying cord 42 as previously described. The two extending leg portions of part 50, each of which provide one half of a closure flap, meet an edge 65 extending therebetween which defines the inner part of the aforementioned throat region, and this edge is provided by folding a portion of the cloth inwardly and stitching to define a reinforcing strip. Likewise, part 52 includes an edge 67 which meets the outwardly extending leg portions thereof, each of which defines the other halves of the closure flaps. Edge 67 is defined by folding a portion of the cloth inwardly and stitching to provide a reinforcing strip. Handles 15 and 16 comprise elongated strips of fabric material sewed or stitched to the outer surface of the flap portion.

As previously mentioned each of the parts 50 and 52 comprises a plurality of smaller parts sewn together to provide the corresponding main part. In the preferred manner of constructing the container bag 10 as illustrated in FIGS. 6 and 7, each part 50 and 52 comprises four smaller parts sewn together, and three of these parts have associated therewith corresponding ones of the pockets or auxiliary compartments 26 which are located inside of the container bag. Referring first to FIG. 6, a first sub-component or part is included between a seam 70 and main seam 53 and extends along the entire length of the part 50. An interior pocket (not shown) extends along the inner portion of seam 70 from the bottom of part 50 to the region adjacent edge 65. A second part is outlined between seam 70 and a seam 71 shown in FIG. 6 which extends from the bottom of the part to a region adjacent edge 65 where it joins edge 57 and is provided with a reinforcing patch 72. A second interior pocket (not shown) is secured to seam 71. A third part is defined between seam 71 and a seam 73 extending from the bottom along the entire length of part 50 including upper right-hand leg portion, the third part having a reinforcing patch 74. A third interior pocket (not shown) is associated with seam 73 extending from the bottom to a point about midway and adjacent edge 65. A fourth part is defined between seam 73 and the main seam 54 and there is no interior pocket associated with this seam.

Proceeding in a similar manner with respect to FIG. 7, a first component thereof extends between main seam 54 and a seam 75. A pocket **26*a* is associated with this part and comprises an extension thereof from seam 75 inwardly to a fold 76 and returning to seam 75 and extending from the bottom of the container bag 10 up to an edge 77 thereof disposed adjacent and slightly below the edge 67 of the throat portion. Pocket 26*a* is open around about edge 77, and the manner of folding and sewing this subcomponent including the pocket 26*a* can be done in a manner providing a reinforcing strip 78 extending upwardly from pocket edge 77 to the reinforcing strip defining edge 62. Similarly, a second subcomponent extends from seam 75 to a seam 79 extending from the bottom of the bag to edge 62 which part has associated therewith a second interior pocket interior 26*b* which extends from seam 79 inwardly to a fold 80 and then returns to seam 79 thereby defining a pocket extending from the bottom of the bag to an edge 81 exposed adjacent the throat edge 67. The folding and sewing of pocket 26*b* is done in a manner similar to that of 26*a* so as to provide a reinforcing strip 82 extending along seam 79. A third subcomponent extends from seam 79 to a seam 83 extending from the bottom of bag 10 to the edge 58. A third interior pocket 26*c* is associated with this component and extends from seam 83 inwardly to a fold 84 returning to seam 83 so as to define a pocket extending from the bottom of bag 10 to an edge 85 disposed at a level adjacent that of edge 67. Pocket 26*c* and its associated part are sewn in a manner providing a reinforcing strip 86 in a manner similar to that of the strips 82 and 78. A fourth component or part extends from seam 83 to the main seam 53 and there is no pocket associated with the seam 53. Preferably each of the pockets 26*a*, 26*b* and 26*c*, and similarly the corresponding three pockets associated with the subcomponents of part 50** which pockets were not shown, are cut to be integral with the corresponding subcomponent part to facilitate assembly. The foregoing construction provides a container which is relatively easy and economical to manufacture.

The aforementioned throat or open region defined between the leg or bib portions serves to enhance the stability of the package comprising anchor 28 and container 10. In particular, the throat affords a structure on which the rod portion of the anchor can rest, if the container 10 is of sufficient length or depth so that the handle of the container is above the center of gravity of the anchor. Thus, the location of the tie line 46 and the grommets (not shown) in the bag to receive the line together with the depth or extent of the throat are considered relative to dumping potential and stability of the anchor in container 10.

The material of pockets 26 alternatively can be of elastic material including a knitted type of material thereby serving to hold the line therein even if the container 10 is inverted. The elastic material of the pockets also will serve to prevent movement of the line from the pockets when the container is subject to vibration. In use, the paying out of line with the anchor pulls the line out of the pockets which under these conditions do not impede the flow or travel of the line.

As a further alternative, the pockets could be connected to the line at spaced locations therealong so that once the sections of line were coiled or otherwise gathered and inserted into the corresponding pockets, the combination of pockets and line would be inserted in the container with the anchor. When the line is payed out, the pockets of course will travel with the line.

It is therefore apparent that the present invention accomplishes its intended objects. While a single embodiment of the present invention has been described in detail, this is done for the purpose of illustration, not limitation.

I claim:

1. A container for stowing an anchor and a length of line connected thereto, said container comprising:

a. a hollow body portion of flexible material closed at one end and open at the other, said body portion having an interior region communicating with said open end and being of sufficient size to accommodate said anchor;

b. means defining a plurality of pockets of flexible material in spaced relation along and around said body portion, each of said pockets having a hollow body portion closed at one end and open at the other end thereof adjacent said open end of said container body portion, each of said pockets having an interior region and the aggregate size of the interior regions of said pockets being of sufficient size to accommodate said line; and c. a movable closure element of flexible material on said open end of said body, said closure element comprising a pair of flaps integral with said body portion and foldable into a closed position over said open end of said container body portion, said closure element being movable from a position covering the open ends of said container body portion and said pockets when said anchor and line are stored therein to an open position allowing said anchor and line to be removed from the container for use;

d. whereby said anchor can be stowed in the interior of said container body portion and said line can be stowed cumulatively in said pockets in a manner preventing fouling thereof and when said anchor is removed from said container for use said line can be payed out sequentially in a manner preventing fouling thereof.

2. A container according to claim 1, wherein said pockets are located along and around the inner surface of said container body portion.

3. A container according to claim 1, wherein each of said pockets is elongated and extends along said container body portion such that each of said closed ends of said pockets is adjacent said closed end of said container body portion.

4. A container according to claim 1, wherein said body portion, pockets and closure element are of canvas material.

5. A container according to claim 1 in combination with an anchor and a length of line, wherein said line comprises a relatively short length of chain and a relatively long length of rope, one end of said chain being connected to said anchor and the other end of said chain being joined to one end of said rope, said anchor and chain being stowed in the interior of said container body portion and said rope being stowed in said pockets.

6. A container according to claim 1, wherein said body portion and closure comprise a pair of identical parts of fabric material joined together along the outer edges thereof and along the one end thereof, each of said parts having a body portion and a pair of spaced apart leg portions extending from the other end thereof, said leg portions providing said closure flaps adjacent the open end of the container.

7. A container according to claim 1, wherein said body portion comprises a pair of identical parts of fabric material joined together along the outer edges and along the one end thereof, each of said parts comprising a plurality of subcomponent parts joined together, a number of said subcomponent parts having said pockets integral therewith inside of said container body portion.

8. A container according to claim 1, wherein said pockets are of elastic material.

9. A container in combination with an anchor and a length of line connected to said anchor, said container comprising a body of flexible material defining an interior region closed at one end and open at the other, said body having a pair of opposed leg portions extending therefrom adjacent said open end, said leg portions defining opposed throat regions for receiving outwardly extending portions of said anchor, and said leg portions being foldable to close said open end whereby said container conforms generally to the shape of said anchor.

10. A container in combination with an anchor and a length of line connected thereto, said container comprising:

a. a hollow body portion closed at one end and open at the other, said body portion having an interior region communicating with said open end and being of sufficient size to accommodate said anchor; and b. a plurality of pocket elements each having a hollow body portion closed at one end and open at the other, each of said pockets having an interior region and the aggregate size of the interior regions of said pockets being of sufficient size to accommodate said line, each of said pockets being connected to said line;

c. whereby said anchor is stowed in the interior of said container body portion, said line is stowed cumulatively in said pocket elements in a manner preventing fouling thereof and said pocket elements and line are stowed in said container body and when said anchor is removed from said container for use said line can be payed out in a manner preventing fouling thereof.

11. A container for stowing an anchor and a length of line connected thereto, said container comprising:

a. a hollow body portion closed at one end and open at the other, said body portion having an interior region communicating with said open end and being of sufficient size to accommodate said anchor;

b. means defining a plurality of pockets of elastic material in spaced relation along and around said body portion, each of said pockets having a hollow body portion closed at one end and open at the other end thereof adjacent said open end of said container body portion, each of said pockets having an interior region and the aggregate size of the interior regions of said pockets being of sufficient size to accommodate said line; and c. a movable closure element on said open end of said body, said closure element being movable from a position covering the open ends of said container body portion and said pockets when said anchor and line are stored therein to an open position allowing said anchor and line to be removed from the container for use;

d. whereby said anchor can be stowed in the interior of said container body portion and said line can be stowed cumulatively in said pockets in a manner preventing fouling thereof and when said anchor is removed from said container for use said line can be payed out sequentially in a manner preventing fouling thereof.

* * * * *